US005608289A

United States Patent [19]

O'Carroll et al.

[11] Patent Number: 5,608,289

[45] Date of Patent: Mar. 4, 1997

[54] FLUORESCENT LAMP ADAPTER WITH SHELL FORM BALLAST

[75] Inventors: James G. O'Carroll, Mill Valley; Bruce A. Pelton, El Sobrante, both of Calif.

[73] Assignee: Lumatech Corporation, Emeryville, Calif.

[21] Appl. No.: 509,656

[22] Filed: Jul. 31, 1995

Related U.S. Application Data

[63] Continuation of Ser. No. 151,578, Nov. 12, 1993, abandoned.

[51] Int. Cl.[6] ..... H01J 7/44

[52] U.S. Cl. ..... 315/58; 315/57; 315/71

[58] Field of Search ..... 315/58, 57, 56, 315/62, 71, 59, 91, 50; 313/318, 315, 317; 362/216, 260

[56] References Cited

U.S. PATENT DOCUMENTS 4,383,200 5/1983 Van Zon et al. ..... 315/57

4,746,840 5/1988 Lim ..... 315/58

4,939,420 7/1990 Lim ..... 315/58

OTHER PUBLICATIONS

Mindell, M. I., "Wound–Steel, 60 Hz Toroidal Transformers Improve Linear Supply Performance", PowerConversion International, Apr. 1985, pp. 58–60.

McGraw–Hill Encyclopedia of Science & Technology, vol. 18 (Sur–Typ), 7th edition, 1992, pp. 479–486.

*Primary Examiner*—Ali Neyzari

*Attorney, Agent, or Firm*—Paula N. Chavez

[57] ABSTRACT

A shell form ballast has rounded corners for positioning inside a ballast housing for use with a fluorescent light bulb adapter. The ballast has rounded outer corners to meet both long-term life and power requirements, and spatial design constraints of a fluorescent lamp adapter assembly for use in an incandescent lighting fixture, and particularly for use in a recessed incandescent lighting fixture. The rounded outer corners of the ballast provide the ability for the shell form ballast to fit into a hollow housing for use in the recessed lighting fixture while simultaneously providing the shell form ballast a snug fit in the hollow housing, thereby minimizing gap growth.

18 Claims, 3 Drawing Sheets

FLUORESCENT LAMP ADAPTER WITH SHELL FORM BALLAST

This is a File Wrapper Continuation of copending application Ser. No. 08/151,578 filed on Nov. 12, 1993, now abandoned.

FIELD OF THE INVENTION

The present invention relates generally to electrical adapters, and more particularly, to lamp adapter devices for adapting fluorescent lamps to incandescent lighting fixtures.

BACKGROUND OF THE INVENTION

Fluorescent lamps have a significant advantage over incandescent bulbs due to the ability of fluorescent lamps to produce equivalent illumination while consuming substantially less electrical power, thereby rendering fluorescent lamps more energy efficient than incandescent bulbs. However, many existing buildings have ceiling mounted recessed fixtures for incandescent lighting installed on the premises instead of recessed fluorescent lighting fixtures. Therefore, there exists a need to adapt fluorescent lamps to fit into and operate in already existing recessed incandescent lighting fixtures.

Unfortunately, the electrical requirements of fluorescent lighting adapter fixtures for installation in recessed incandescent fixtures makes them quite large in size, and therefore they often fail to satisfy spacial and aesthetic requirements. Efforts have been made to develop an assembly which meets the spacial and aesthetic design considerations of an adapter fixture for recessed incandescent lighting assemblies.

Those devices which do succeed in meeting the spacial design constraints for recessed lighting fixtures often fail to maintain long-term power requirements.

For example, one prior art device provides a configuration where a toroidal ballast surrounds the lamp in an attempt to meet both power and design considerations as described in U.S. Pat. No. 4,623,823. While this device allows all of the components to fit comfortably within a recessed lighting fixture, since the stem of the fluorescent lamp is encompassed by the toroidal ballast, the heat from the fluorescent lamp is retained instead of being dispersed. Therefore, the lamp often reaches temperatures high enough to cause its failure over periods far shorter than its rated life. Furthermore, the excessive temperatures cause early deterioration not only of the lamp and its starter, but also of the ballast components, thereby severely limiting the service life of the device as well as of the lamps.

A second prior art device as described in U.S. Pat. No. 4,746,840, while solving some of the above listed problems, added new problems. There, a rectangular core form ballast is fitted within a hollow annular housing and surrounds the lamp base. However, while this device does not subject the lamp and ballast to as much heat, it also has a more limited service life than desired due to gaps in the ballast which enlarge over time in the course of normal use. This gap widening is particularly problematic because the larger the gap widens, the more power the ballast needs in order to operate the lamp at the same level of illumination. In addition to loss of power, these gaps also result in considerable audible noise caused by the resonant vibrations of the separate ballast parts in the air gap and against one another.

Accordingly, there is a need to avoid close contact between the ballast and the light source to avoid excess heat build up, while still meeting the voltage requirements for a compact fluorescent lamp. There is also a need to minimize growth in the width of air gaps formed in the ballast in order to minimize power loss and audible noise caused by such gaps.

SUMMARY OF THE INVENTION

The present invention includes a shell form ballast (also known as an El ballast) with its outer corners rounded to meet both long-term life and power requirements and spatial design constraints of a fluorescent lamp adapter assembly for use in an incandescent lighting fixture, and particularly for use in a recessed incandescent lighting fixture. The rounded outer corners of the ballast of the present invention provide the ability for the shell form ballast to fit into a hollow housing for use in a recessed lighting fixture while simultaneously providing the shell form ballast a snug fit in the hollow housing, thereby minimizing gap growth.

In the preferred embodiment, the ballast is embedded in a hollow housing with the rounded corners fitting snugly against the interior of the housing and with braces between the ballast sides and the housing reinforcing the tight fit. As mentioned above, this snug fit gives the ballast stability and constraint within the housing and thus helps to inhibit the growth of the gap which would otherwise naturally develop through normal use. Therefore, both power loss and audible noise are reduced as compared to a ballast with a less tight fit within the hollow housing, thereby extending the service life of the ballast.

At either end of the ballast constrained within the housing are connectors, the first of which is a base connector for attaching the adapter assembly to an incandescent lighting fixture, and the second of which is a lamp connector for attaching the adapter assembly to a fluorescent lamp. Since the positioning of the fluorescent lamp base and stem is in series with the shell form ballast, the configuration of the present invention prevents overheating of either the fluorescent lamp base or of the other ballast components. Appropriate electrical connections are provided to complete the assembly.

DESCRIPTION OF PREFERRED EMBODIMENTS

Figure 1:
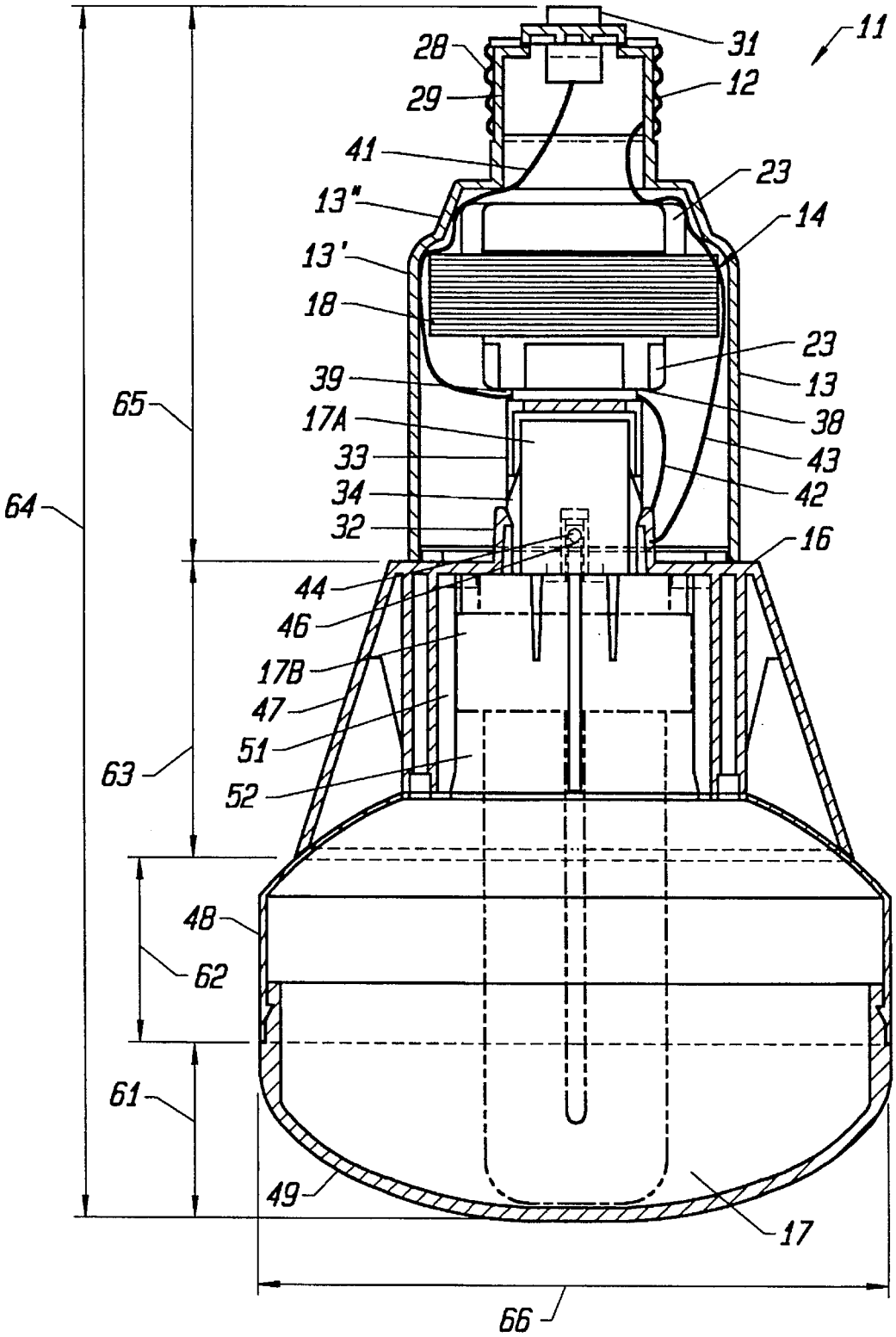
FIG. 1 is a longitudinal cross-sectional view of a fluorescent lamp adapter assembly of the present invention, also showing an associated fluorescent lamp.

Referring to FIG. 1, a fluorescent lamp adapter assembly 11 generally includes a base connector 12, a housing 13 substantially surrounding a ballast 14 mounted on the base connector 12. The housing 13 has an upper portion 13' which typically narrows to a small circumference closest to the base connector 12, thus having a frusto-conical shape, such indicated by region 13". It is in this region, 13' and 13"

where the ballast 14 of the present invention resides. A lamp holder portion 16 is attached to the housing 13 for purposes of retaining a standard conventional fluorescent lamp 17.

Figure 2:
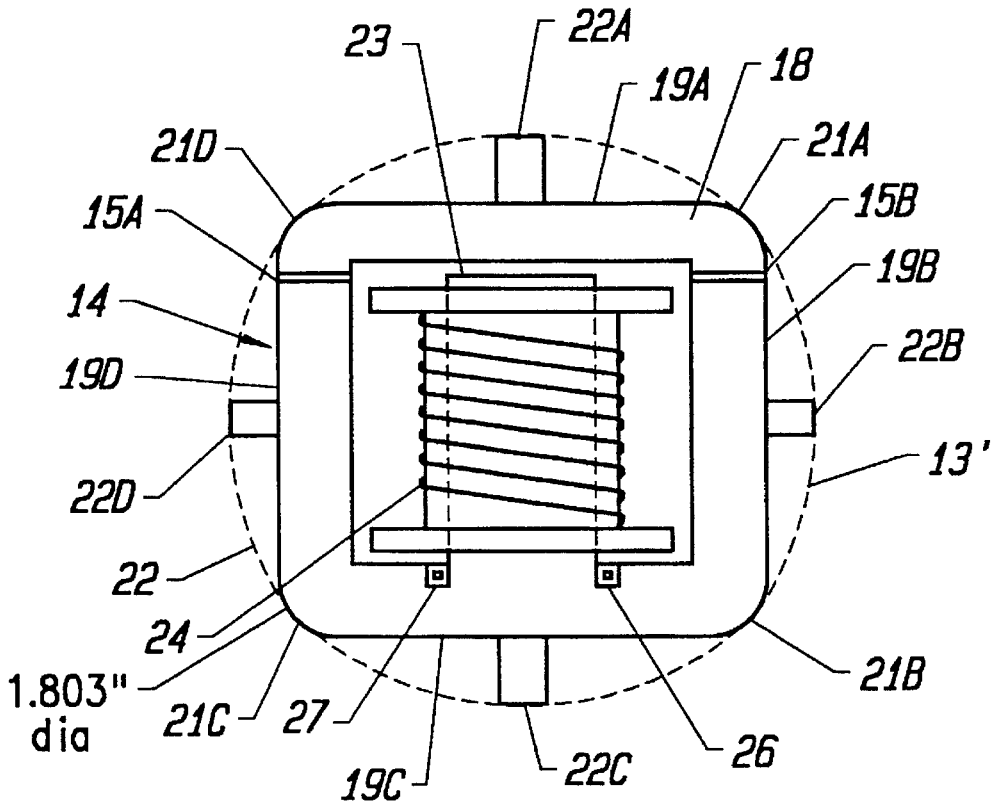
FIG. 2 is a top perspective view of the higher wattage single-coil embodiment of a shell form ballast with rounded corners illustrated in FIG. 2, also showing associated braces to fix the ballast within the hollow housing.

Turning to FIG. 2, a top view of the ballast 14 superimposed in the housing 13 is shown. The ballast 14 includes air gaps 15A and 15B. These gaps in the laminated layers of the magnetic perimeter portion which are caused in the manufacturing process are unavoidable due to the orientation requirements of the magnetic materials. The upper portion 13' of housing 13 is depicted in dotted lines. As shown, the ballast 14 includes a perimeter portion 18 having four side members 19A, 19B, 190 and 19D, each of which meets adjacent side members in rounded corners 21A, 21B, 21C and 21D. In the preferred embodiment, the ballast 14 is fixed positionally in the housing 13 by the tight fitting of the rounded corners abutting against the interior of the upper portion 13'.

The securing mechanism of the fitted rounded corners of the present invention applies tight stabilizing forces to the ballast 14, thereby preventing widening of air gaps 15A and 15B in the perimeter portion 18 during the course of normal usage.

In furtherance of securing the ballast 14 in its position within the housing 13, braces 22A, 22B, 22C and 22D are positioned between the ballast and the housing 13 along the linear portions of the side members. As few as two braces can provide support for the ballast, and such braces can take many configurations. However, it is preferable that the brace does not come into contact with the rounded corners so that space constraints are observed in accordance with the present invention. With this additional support, air gap widening is virtually avoided, thus providing lengthened service life with minimum power degradation as well as a reduced chance of resonant vibration.

The ballast wires are wrapped around center segment 23 which emanates inward from one of the side members 19C of the perimeter portion 18 as shown in FIG. 2.

Figure 3:
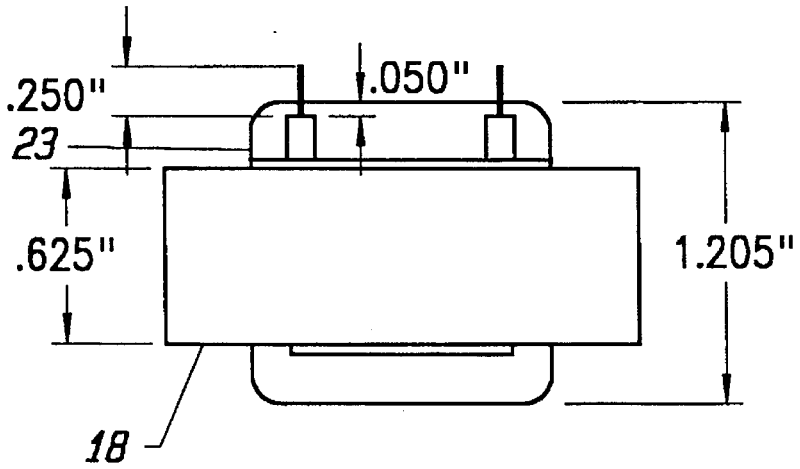
FIG. 3 is a side perspective view of the ballast shown in FIG. 2, a single coil embodiment of a shell form ballast with rounded corners of the present invention.

A side view of the ballast 14 is shown in FIG. 3. Center segment 23 and the coil 24 which is wrapped about it typically protrudes above and below the perimeter portion 19. Returning again to FIG. 1, it can be seen that the protrusion of center segment 23 is positioned within region 13". Thus, the shell form ballast is able to generally fit in a typical fluorescent adapter housing 13.

In one embodiment, one electrically conducting coil 24 winds around the center segment 23. The coil 24 has one end attached to an incoming metallic ballast contact 26 and the other end attached to an outgoing metallic ballast contact 27. As mentioned above, and as is well known, the perimeter portion 18 and the center segment 23 are formed from a magnetically conducting material such that when an electrical current is applied to the incoming metallic ballast contact 26, a magnetic flux is induced which alters the current passing out of the outgoing metallic ballast contact 27. This enables the current applied by an incandescent lighting socket to be adapted to a fluorescent lamp 17 which has different electrical current requirements than an incandescent bulb.

The dimensions of the shell form ballast depend upon the power requirements of the fluorescent lamp. Since power output is a function of surface area of the core and coil, any decrease in the surface area of the core by the rounded corners is compensated by either height of the perimeter portion 18 or number of windings of coil 24. A balance between surface area and coil windings is required in accordance with the present invention because too much or too little of either can cause there to be too much or too little power to the lamp at both start up and after it is on-line. The rounded corners further cause the magnetic flow to be altered at those junctions; therefore height of the perimeter portion 18 is to be considered a variable in attenuating magnetic flow problems.

As discussed above, referring to FIG. 1, the ballast of the present invention is incorporated into an adapter with a base connector 12 for a conventional screw-type or "Edison" base which can be screwed into recessed incandescent lighting sockets. The base connector 12 includes a metallic threaded member 28 adapted to engage the interior sidewall of a conventional incandescent lighting socket (not shown) of, for example, a recessed lamp fixture, to provide mechanical and electrical connection. Furthermore, the base connector 12 includes a cylindrical core member 29 formed of an electrically insulating material to support the threaded member 28. The base connector 12 also includes a base metallic contact 31 mounted to the basal end of the cylindrical core member 29 for electrically engaging an incandescent lighting socket.

The base metallic contact 31 is electrically separated from the threaded member 18 by the insulating core member 29.

Also as mentioned above, the housing 13 includes a generally cylindrical sidewall mounted in an upright position to a generally frusto-conical member whose smaller end is attached to the cylindrical core member 29. The housing 13 further includes a lamp receiving member 32 whose outer periphery engages the cylindrical sidewall of the housing 13. The lamp holder member 32 includes an interior wall 33 that defines a central recess 34 to receive the base 17A of a standard conventional fluorescent lamp 17. The fluorescent lamp 17 may include a 5, 7, 9, 13 or other watt variety and may comprise one or more tubes. In accordance with the present invention, the central recess 34 is sufficiently distanced from the ballast 14 such that operation of the fluorescent lamp 17 in connection with the ballast 14 will not cause overheating either of the base 17A and stem 17B of the fluorescent lamp 17, or of the ballast 14.

Figure 4:
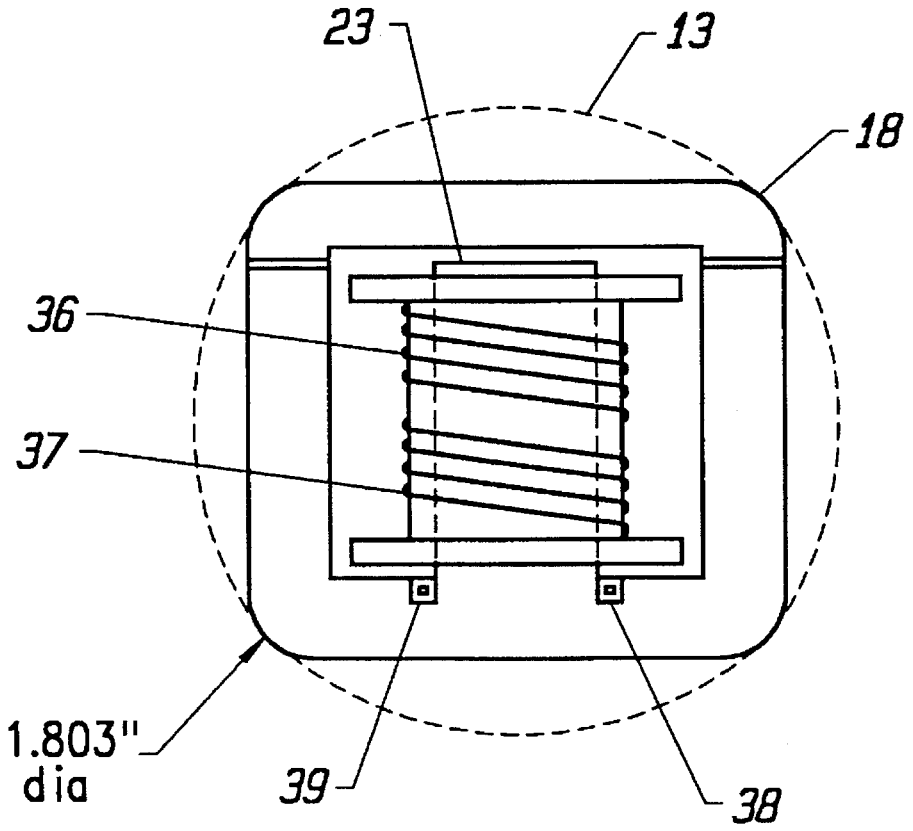
FIG. 4 is a top perspective view of a multiple-coil embodiment of a shell form ballast with rounded corners of the present invention.

In another embodiment of the present invention, more than one coil may be wound about the center segment 23. Referring to FIG. 4, the ballast 14 includes two electrically conducting coils, incoming coil 36 and outgoing coil 37, wound either concentrically or interweaved on the center segment 23. The incoming coil 36 is attached at one end to the incoming metallic ballast contact 38 and at the other end to the ground of the incandescent lighting socket. The outgoing coil 37 is attached at one end to the outgoing metallic ballast contact 39 and at the other end to the ground of the fluorescent lamp 17. When an electrical current is applied to the incoming metallic ballast contact 38, the resulting current in the incoming coil 36 causes a magnetic flux which induces a different current to flow through outgoing coil 37 and pass out of the outgoing metallic ballast contact 39. This again enables the current applied by an incandescent lighting socket to be adapted to a fluorescent lamp 17.

Again referring to FIG. 1, a first electrical interconnection 41 electrically connects the base metallic contact 31 to the incoming metallic ballast contact 38. A second electrical interconnection 42 runs from the outgoing metallic ballast contact 39 to the entry contact 44 of the fluorescent lamp 17. A third electrical interconnection 43 completes the circuit by running from the exit contact 46 of the fluorescent lamp 17 to the metallic threaded member 28 which is mechanically and electrically attached to the interior sidewall of the incandescent lighting socket which serves as the ground for the socket. Thus, a voltage applied by the incandescent lighting socket will cause electrical current to flow through the electrical interconnections staring from the base metallic contact 31 through the coil or coils of the ballast 14 to the entry contact 44 of the fluorescent lamp 17 and back to the socket ground by way of the metallic threaded member 18.

Generally, the lamp holder portion 16, including a frusto-conical retaining member 47 and a rounded translucent cover member 49, retains the fluorescent lamp 17 in the adapter assembly 11. The frusto-conical retaining member 47 engages at its smaller end the outer periphery of the lamp receiving member 32 and engages at its larger end a generally cylindrical opaque member 48. The frusto-conical retaining member 47 includes an interior sidewall 51 which defines a central cavity 52 into which the fluorescent lamp base 17B snugly fits. The generally cylindrical opaque member 48 is in turn attached to a rounded translucent cover member 49 which permits the passing of light from the fluorescent lamp 17.

Illustratively, the fluorescent lamp adapter assembly 11 has the following dimensions. The dimension 61 is 0.98 inches (24.9 mm). The dimension 62 is 1.02 inches (25.9 mm). The dimension 63 is 1.67 inches (42.4 mm). The dimension 64 is 6.85 inches (174.0 mm). The dimension 65 is 3.18 inches (80.8 mm). The dimension 66 is 3.75 inches nominal (95.2 mm). Illustratively, the fluorescent lamp adapter assembly 11 operates a 9 watt PLQ fluorescent lamp 17. Illustratively, the fluorescent lamp 17 has an overall length of 4.40 inches (111.8 mm). A fluorescent lamp adapter assembly 11 according to the invention is available from Lumatech, Inc. of Emeryville, Calif. as Model No. 80923.

The invention claimed is:

1. A device, comprising:

(a) a ballast, comprising:

a center segment;

an electrically conducting coil wound about said center segment capable of conducting an electrical current therethrough;

a perimeter portion substantially surrounding said center segment, said perimeter portion having four side members, each side member having opposing distal ends wherein each of said side members' distal ends meets with one of an adjacent side members' distal ends, said meeting ends together forming a rounded corner with a curved peripheral contour, and wherein said perimeter portion includes at least one air gap having a predetermined thickness, said air gap being capable of enlargement when an electrical current is applied to said electrically conducting coil; and (b) a lamp adapter assembly which is adapted for use in an incandescent lighting socket, including electrical connection elements which interconnect said electrically conducting coil with said incandescent lighting socket and a lamp positionable within said lamp adapter assembly and wherein said lamp adapter assembly is configured to tightly position said perimeter portion of said ballast device therein in a manner which avoids said enlargement of said air gap to maintain said air gap at said predetermined thickness.

2. A device as recited in claim 1, further comprising a second electrically conducting coil wound about said center segment.

3. A device as recited in claim 1, wherein said device is positionable in a fluorescent lamp adapter assembly for use with a fluorescent lamp, said fluorescent lamp adapter assembly being adapted to fit into an incandescent lighting fixture, and wherein said coil and said perimeter portion have sufficient combined surface area to provide the ability to control electrical energy to operate said fluorescent lamp resident in said fluorescent.

4. A device as recited in claim 2, wherein said device is positionable in a fluorescent lamp adapter assembly for use with a fluorescent lamp, said fluorescent lamp adapter assembly being adapted to fit into an incandescent lighting fixture, and wherein said coils and said perimeter portion have sufficient combined surface area to provide the ability to control electrical energy to operate said fluorescent lamp resident in said fluorescent.

5. A device as recited in claim 1, wherein said device further comprises bracing means attachable to at least two of said four side members, said bracing means providing the ability to aid in securing said device within a fluorescent lamp adapter assembly.

6. A device for use with a compact fluorescent lamp, comprising:

(a) a ballast, comprising:

a rectangular periphery portion having interior and exterior surfaces and having rounded exterior corners and at least one air gap having a predetermined thickness;

a center segment portion emanating inward from one of said interior surfaces of said rectangular periphery, said center segment portion thereby substantially surrounded by said rectangular periphery portion;

at least one electrically conducting coil wound around said center segment portion, said coil and said rectangular periphery portion having sufficient combined surface area such that when an electrical current passes through said coil, the output current generated therefrom is controlled to power said compact fluorescent lamp; and wherein said air gap is capable of growth when said electrical current passes through said coil;

(b) a fluorescent lamp adapter assembly which is adapted for use in an incandescent lighting socket and which houses said ballast to tightly position said rectangular periphery portion therein and in a manner which avoids said growth of said air gap to maintain said air gap at said predetermined thickness; and (c) electrical interconnection elements for establishing interconnections with said incandescent lighting socket and with said compact fluorescent lamp positioned in said fluorescent lamp adapter assembly.

7. A device as recited in claim 6, further comprising a second electrically conducting coil wound about said center segment portion.

8. A device as recited in claim 6, wherein said device is positionable in a fluorescent lamp adapter assembly for use with a fluorescent lamp, said fluorescent lamp adapter assembly being adapted to fit into an incandescent lighting fixture, and wherein said coil and said rectangular periphery portion have sufficient combined surface area to provide the ability to control electrical energy to operate said compact fluorescent lamp resident in said fluorescent lamp adapter assembly.

9. A device as recited in claim 7, wherein said device is positionable in a fluorescent lamp adapter assembly for use with a fluorescent lamp, said fluorescent lamp adapter assembly being adapted to fit into an incandescent lighting fixture, and wherein said coils and said rectangular periphery portion have sufficient combined surface area to provide the ability to control electrical energy to operate said compact fluorescent lamp resident in said fluorescent lamp adapter assembly.

10. A device as recited in claim 6, wherein said device further comprises bracing means attachable to said rectangular periphery portion, said bracing means providing the ability to aid in securing said device within a fluorescent lamp adapter assembly.

11. A fluorescent lamp adapter assembly for adapting a fluorescent lamp to an incandescent lighting fixture, comprising:

(a) a housing:

(b) a ballast including a center segment having wrapped thereon at least one coil, said center segment substantially surrounded by a peripheral portion having exterior corners which are rounded, said peripheral portion including at least one air gap having a predetermined thickness, said air gap being capable of growth during use of said ballast, said ballast tightly positionable within said housing in a manner which avoids said growth of said air gap to maintain said air gap at said predetermined thickness;

(c) first connector means in communication with said at least one coil for establishing electrical interconnection between said ballast and said incandescent lighting fixture; and (d) second connector means in communication with said coil for establishing electrical interconnection between said ballast and said fluorescent lamp.

12. An assembly as recited in claim 11, further comprising a second electrically conducting coil wound about said center segment.

13. An assembly as recited in claim 11, wherein said device is positionable in a fluorescent lamp adapter assembly for use with said fluorescent lamp, said fluorescent lamp adapter assembly being adapted to fit into an incandescent lighting fixture, and wherein said coil and said peripheral portion have sufficient combined surface area to provide the ability to control electrical energy to operate said fluorescent lamp resident in said fluorescent lamp adapter assembly.

14. An assembly as recited in claim 12, wherein said device is positionable in a fluorescent lamp adapter assembly for use with said fluorescent lamp, said fluorescent lamp adapter assembly being adapted to fit into an incandescent lighting fixture, and wherein said coils and said peripheral portion have sufficient combined surface area to provide the ability to control electrical energy to operate said fluorescent lamp resident in said fluorescent lamp adapter assembly.

15. An assembly as recited in claim 11, wherein said device further comprises bracing means attachable to said peripheral portion, said bracing means providing the ability to aid in securing said device within said housing.

16. An adapter for adapting a fluorescent lamp to an incandescent lighting fixture, comprising:

(a) a housing:

(b) a ballast positioned within the housing, wherein the ballast has a configuration which includes at least one air gap of a predetermined thickness, said air gap being capable of growth during the use of said ballast, and has a shape such that one or more surfaces of the ballast contact the housing to hold the ballast in a fixed relationship to the housing and in a manner which avoids said growth of said air gap to maintain said air gap at said predetermined thickness; and (c) an electrically conducting coil, the coil being held within the ballast in a fixed relationship to the ballast.

17. An adapter as in claim 16, wherein:

the housing has a substantially circular interior shape into which the ballast is positioned;

the shape of the ballast is substantially rectangular when viewed in a direction parallel to the toroidal axis; and the corners of the rectangular shape are rounded to fit snugly against the housing.

18. An adapter as in claim 17, further comprising a plurality of braces, each brace positioned between the housing and a side of the substantially rectangular shape of the ballast to aid in securing the ballast within the housing.

* * * * *